US005826848A

United States Patent [19]

Cekosh

[11] Patent Number: 5,826,848

[45] Date of Patent: Oct. 27, 1998

[54] COVER FOR BRACKET

[76] Inventor: Deborah Ann Cekosh, 18020 Westside Hwy. SW., Vashon Island, Wash. 98070

[21] Appl. No.: 885,488

[22] Filed: Jun. 30, 1997

[51] Int. Cl.[6] ..... A47B 95/00

[52] U.S. Cl. ..... 248/345.1; 248/248

[58] Field of Search ..... 248/345.1, 200, 248/300, 247, 248, 235, 915, 615

[56] References Cited

U.S. PATENT DOCUMENTS

| | | | |
|---|---|---|---|
| D. 345,499 | 3/1994 | Padilla | D8/381 |
| 2,509,468 | 5/1950 | Anderson, Jr. | 229/14 |
| 3,220,683 | 11/1965 | Doll | 248/345.1 |
| 3,604,670 | 9/1971 | Reeves | 248/250 |
| 3,606,229 | 9/1971 | Wall | 248/345 |
| 3,707,273 | 12/1972 | Bortz | 248/235 |
| 3,984,077 | 10/1976 | Shine | 248/248 |
| 4,192,423 | 3/1980 | Rekow | 206/586 |
| 4,431,155 | 2/1984 | Engel | 248/243 |
| 5,048,689 | 9/1991 | McFarland | 206/586 |
| 5,253,835 | 10/1993 | Herron, III | 248/220.2 |
| 5,423,510 | 6/1995 | Almoslino | 248/345.1 |
| 5,560,580 | 10/1996 | Almoslino | 248/345.1 |

*Primary Examiner*—Leslie A. Braun
*Assistant Examiner*—Anita M. King
*Attorney, Agent, or Firm*—Stratton Ballew PLLC

[57] ABSTRACT

An article for forming a cover for a bracket, a method of forming a cover for a bracket from the article, and a cover for a bracket having a substantially pyramidal form, and created from central panel of a flexible sheet material including a first fold line for defining a first substantially triangular panel and a second substantially triangular panel, and at least one flap of a flexible sheet material having an edge in common with an edge of one of the first and the second panels which defines a second fold line.

22 Claims, 7 Drawing Sheets

COVER FOR BRACKET

BACKGROUND OF THE INVENTION

1. Field Of The Invention

The present invention relates generally to shelving systems, and in a more particular sense to coverings for the brackets which are used to support shelves.

2. Description Of The Invention

One popular shelving system includes metal rails or channels and blade-like brackets. The rails are affixed to a wall surface using screws or other fasteners. The rails include a series of slots distributed over the length of the rail. The brackets have a generally blade-like shape and are often made of metal. Each bracket has a pair of hooks formed at one end, and will often have an up-turned lip at the other end. The hooks are designed for being received within the slots of the rails. The lip is designed to engage the front end of a shelf and thereby retain the shelf in place on the brackets. The height of the shelf is adjusted by selecting the slots of the rail into which the hooks of the bracket are removably received.

In another popular shelving system, a V-shaped bracket is fastened directly to the wall. The bracket is designed to provide support to a wire shelf. The shelf is additionally supported by U-shaped clamp members which are also fastened directly to the wall by way of screws or other fasteners.

Other, less popular, shelving systems exist which also depend on brackets to support the shelf. In almost all cases, the brackets are designed for utility and do not present a pleasant appearance.

Several inventors have attempted to addressed the poor appearance of shelf brackets. For example, Engel in U.S. Pat. No. 4,431,155 discloses a Cover Sleeve For Shelving Brackets Of The Blade Type; Bortz in U.S. Pat. No. 3,707,273 discloses a Shelf Bracket Cover; Almoslino in U.S. Pat. Nos. 5,423,510 and 5,560,580 discloses a Decorative Covering For Shelf Brackets And Standards; and Herron in U.S. Pat. No. 5,253,835 discloses a Shelf Bracket Assembly.

In all of these examples, a bracket cover is formed from either metal, plastic, or other materials using conventional machining and molding techniques. The cost and complications of such an approach is somewhat prohibitive. The prohibitive cost makes it unlikely that the covers will be replaced each time a room is redecorated or painted.

There is a demonstrated need in the field of shelving systems for an inexpensive, lightweight, easy to use, and highly decorative cover for a bracket.

SUMMARY OF THE INVENTION

The invention of the present application is an article for forming a cover for a bracket, a method of forming a cover for a bracket from the article, and a cover for a bracket.

A first object of the invention is to provide an inexpensive, lightweight, and decorative flexible sheet of material from which a cover for a bracket which may be easily assembled.

A second object of the invention is to provide a method of fashioning an inexpensive, lightweight, and decorative cover for a bracket from a flexible sheet of material.

A third object of the invention is to provide an inexpensive, lightweight, and decorative cover for a bracket which may be easily assembled from a flexible sheet of material.

The invention is a cover for a bracket, the cover being formed by providing a cover forming article, manipulating or folding the article into a generally pyramidal form, and securing certain sides of the cover forming article into place. The cover forming article defines at least a first panel, a second panel and a third panel. The first and second panels defining sides and the third panel defining a top.

The cover forming article comprises a central panel of flexible sheet material and at least a first flap of flexible sheet material. The central panel has a first edge, a second edge, a third edge, a fourth edge and a first fold line defined along a hypotenuse of a triangle defined by the first and the second edges of the central panel. The first flap has a first edge hingedly joined to the fourth edge of the central panel at a second fold line, a second edge which along with the first edge defines an acute angle therebetween, a third edge, a fourth edge, a fifth edge, and a third fold line extending along the hypotenuse of a triangle defined by the first and the third edges of the first flap.

The cover forming article may include a second flap. The second flap has a first edge hingedly joined to the third edge of the central panel at a fourth fold line, a second, a third edge, a fourth edge,, a fifth edge, and a fifth fold line extending along a hypotenuse of a triangle formed by the first and the fifth edges of the second flap.

The cover is normally put in use by folding it around the bracket it is to cover. The first and the second panels serve as the primary surfaces. The third panel, or first flap, normally acts as the upper surface, which is received flush with the bottom of a shelf. Either the open rear portion or the outside surface of the second flap is received flush with the wall. The cover is preferably secured to the shelf or wall by way of adhesive.

The cover forming article may be formed from paper, paperboard, fiberboard, paperboard coated with plastic, corrugated cardboard and light gauge metal. The outside surface may be painted, colored or decorated in any conventional manner.

DESCRIPTION OF THE PREFERRED EMBODIMENTS

Figure 1:
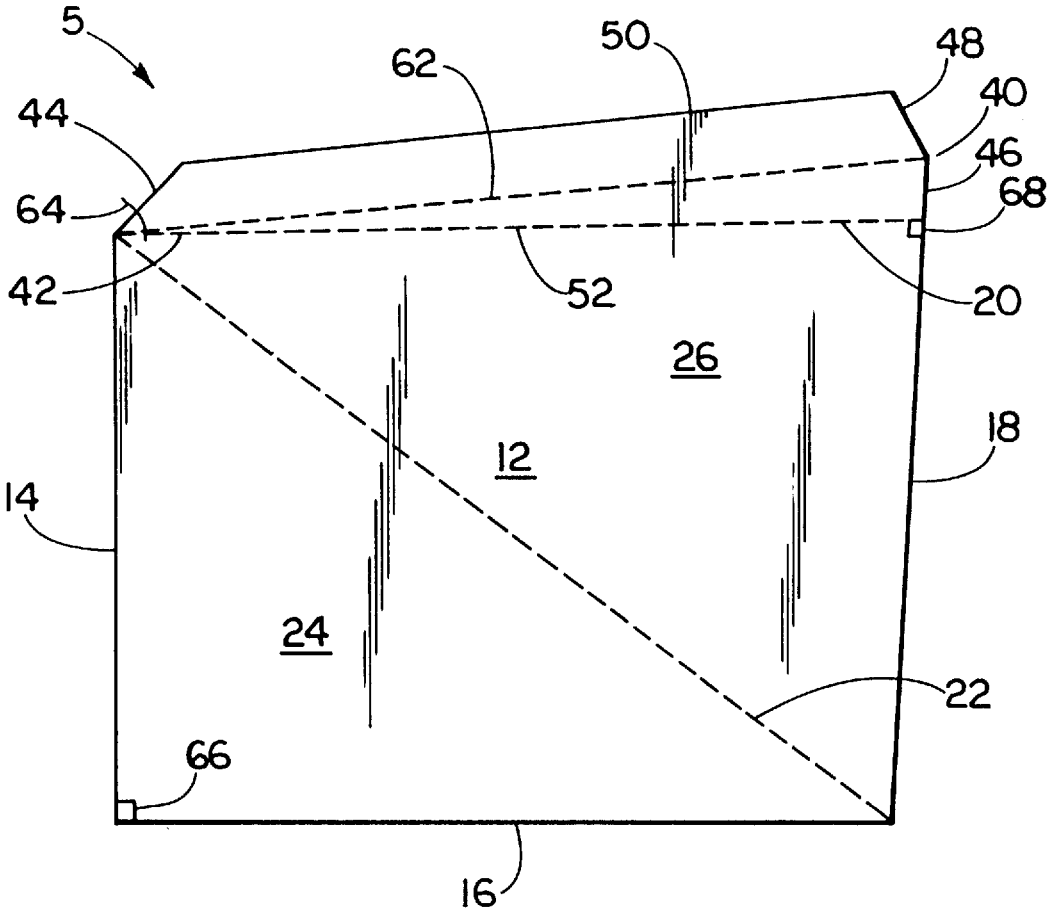
FIG. 1 shows a first preferred embodiment of an article for forming a cover, including a central panel and a first flap.
Figure 8:
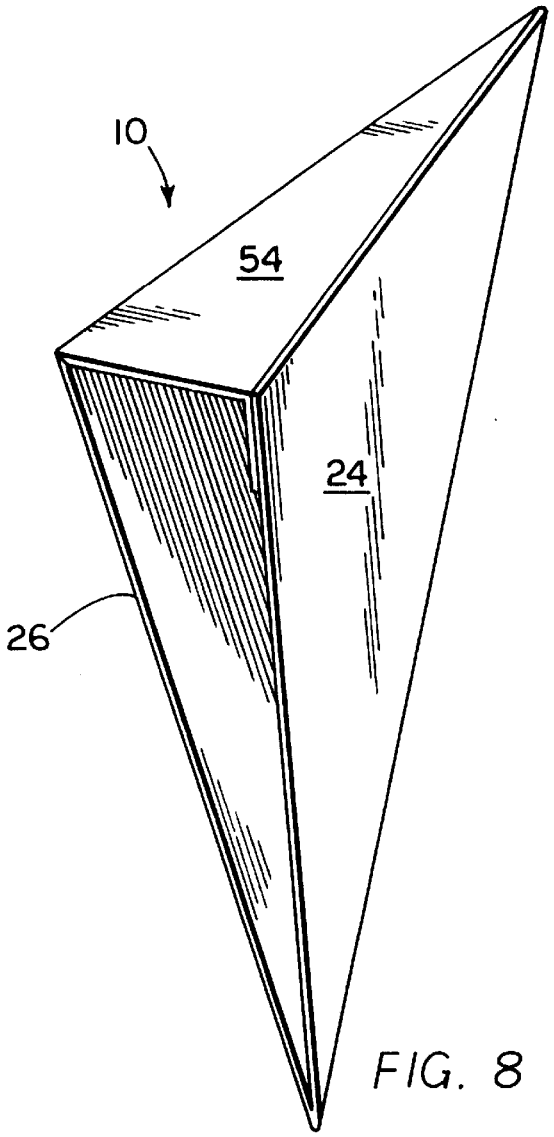
FIG. 8 shows a rear perspective view of the first preferred embodiment of the cover.

With reference to FIG. 1, a first preferred embodiment of a flexible sheet material 5 is shown, from which the cover 10, as shown in FIG. 8, may be easily fabricated by simple manipulations. The flexible sheet material 5 may be any material selected from the group consisting of paper, paperboard, fiberboard, paperboard coated with plastic, corrugated cardboard and light gauge metal. The gauge of the metal should be sufficiently light, so as to allow the material to be folded or bent without the need of excessive force or tools. Other flexible materials may be used, although paperboard and cardboard are preferred. Fold lines may be formed in any conventional manner including pre-folding or scoring the flexible sheet material.

The flexible sheet 5 includes a central panel 12 having a first edge 14, a second edge 16 adjacent to the first edge 14, a third edge 18 adjacent the second edge 16, a fourth edge 20 adjacent the first edge 14 and the third edge 18 of the central panel 12.

The central panel 12 includes a first fold line 22 defined along a hypotenuse of a triangle defined by the first 14 and the second edges 16 of the central panel 12. The first fold line 22 also coincides with the hypotenuse of a triangle defined by the third 18 and fourth edges 20 of the central panel 12.

Figure 4:
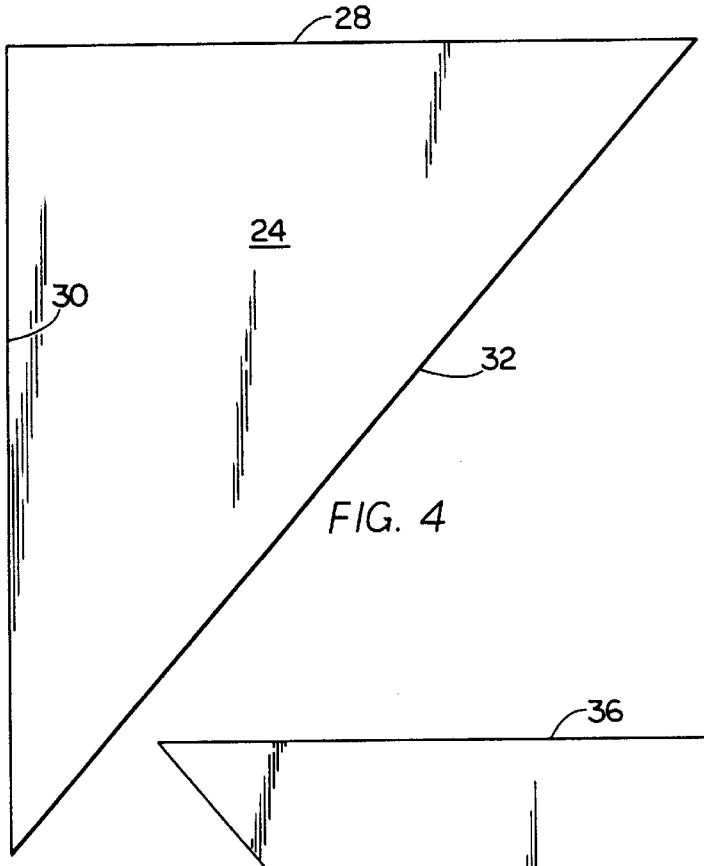
FIG. 4 shows in a left side elevational view, the first panel of the cover.
Figure 5:
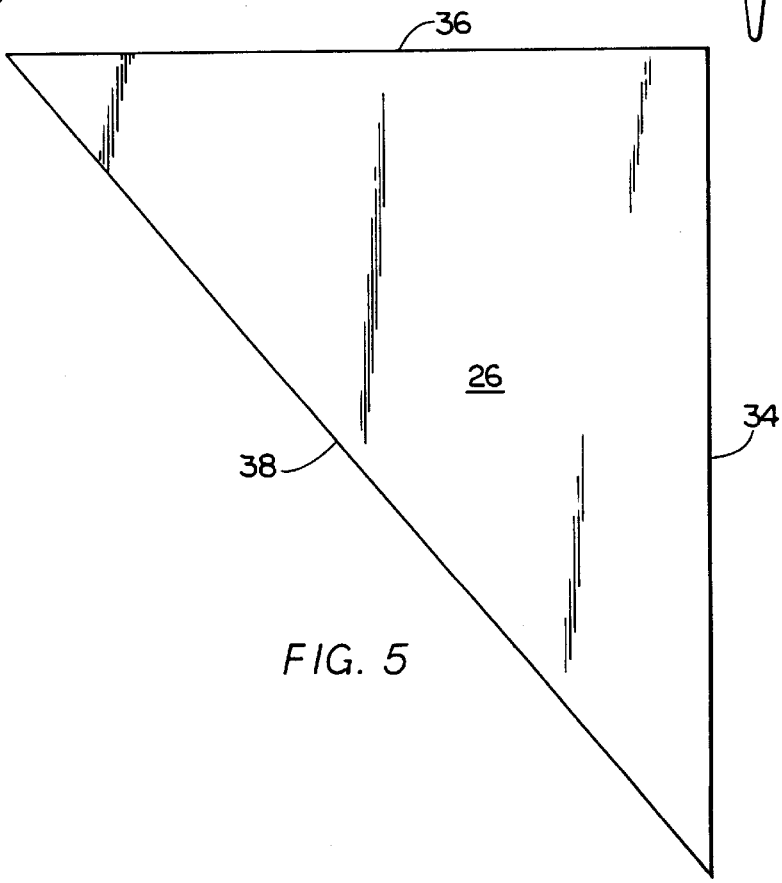
FIG. 5 shows in a right side elevational view, the second panel of the cover.

With reference to FIGS. 4 and 5, the first fold line 22 permits the central panel 12 to be easily folded into a first panel 24 and a second panel 26, the corner defined by the intersection of the first and second edges 14, 16 of the central panel 12 and the corner defined by the intersection of the third and fourth edges 18, 20 of the central panel 12 being drawn together. The first panel 24 and the second panel 26 being folded into a tent like shape. With particular reference to FIG. 4, the first panel 24 is circumscribed by the first edge 28, second edge 30 and a third edge 32 of the first panel 24 which are respectively coincident with the first edge 14, second edge 16 and first fold line 22 of the central panel 12. With particular reference to FIG. 5, the second panel 26 is circumscribed by first edge 34, a second edge 36, and a third edge 38 of the second panel 26, which are respectively coincident with the third edge 18, fourth edge 20 and first fold line 22 of the central panel 12.

Figure 6:
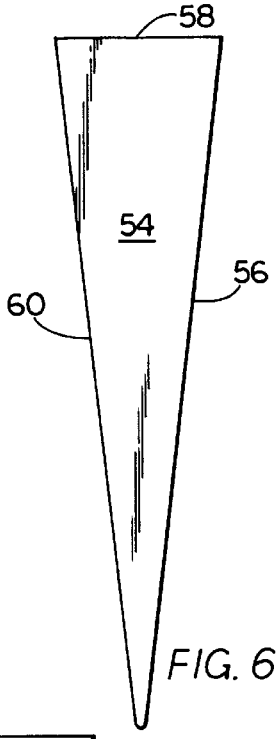
FIG. 6 shows in a top view, the third panel of the cover.

With reference to FIG. 1, the flexible sheet 5 also includes a first flap 40. The first flap 40 has a first edge 42, a second edge 44, a third edge 46, a fourth edge 48 and a fifth edge 50. The first edge 42 of the first flap 40 is hingedly joined to the fourth edge 20 of the central panel 12 at a second fold line 52. With reference to FIGS. 1, 6 and 8, the second fold line 52 permits the first flap 40 to be folded so as to form a third panel 54, providing a top wall, connecting the first 14 and fourth edges 20 of the central panel 12. The third panel 54 has a first edge 56, second edge 58 and third edge 60, which are respectively coincident with the first edge 42, the third edge 46 and a third fold line 62 of the first flap 40.

With further reference to FIG. 1, the second edge 44 of the first flap 40 is positioned with an end adjacent an end of the first edge 42 of the first flap 40. The first and the second edges 42, 44 of the first flap 40 define an acute angle 64 between them, the first edge 42 coincident with the fourth edge 20 of the central panel 12. The angle 64 may be defined by a cut or a fold along the second edge 44. The acute angle 64 between the first and second edges 42, 44 of the first flap 40 permits the first flap 40 to be folded along the second fold line 52 without interfering with the central panel 12.

With continuing reference to FIG. 1, an end of the third edge 46 of the first flap 40 is positioned adjacent the opposite end of the first edge 42 of the first flap 40 from the second edge 44 of the first flap 40. An end of the fourth edge 48 of the first flap 40 is positioned adjacent the opposite end of the third edge 46 of the first flap 40 from the end adjacent the second edge 44 of the first flap 40. The fifth edge 50 of the first flap 40 has one end adjacent the second edge 44 and another end adjacent the fourth edge 48 of the first flap 40.

The third fold line 62 is defined on the first flap 40, extending along the hypotenuse of a triangle defined by the first and the third edges 42, 46 of the first flap 40. The third fold line 62 allows a portion of the first flap 40 to be folded flat against the central panel 12, thereby permitting the first flap 40 to be secured into place relative to the central panel 12 through the use of adhesives, fasteners and the like.

The cover 10 will most often be used on a substantially flat wall. Therefore, in the preferred embodiment, the first and the second edges 14, 16 of the central panel 12 define a substantially right angle 66 therebetween. Likewise, to maintain symmetry, the third and the fourth edges 18, 20 of the central panel 12 define a substantially right angle 68 therebetween. Also to allow the bracket cover 10 to lie flat against a wall, it is further preferred that the third edge 46 of the first flap 40 be collinear to the third edge 18 of the central panel 12.

Also to maintain symmetry, it is preferred that the length of the first edge 12 and length of the third edge 18 of the central panel 12 are equal. Likewise, the length of the second edge 16 and the fourth edge 20 of the central panel 12 are equal length.

Figure 2:
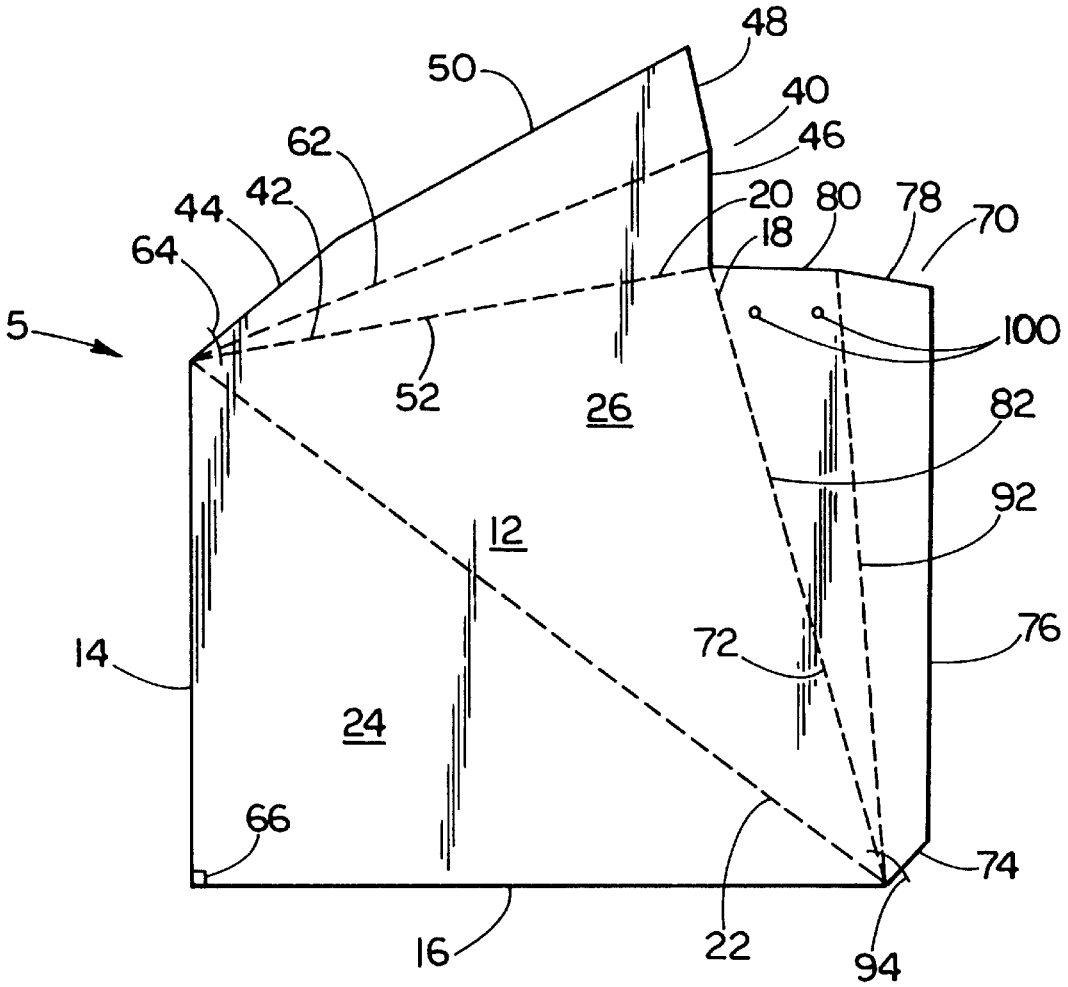
FIG. 2 shows a second preferred embodiment of an article for forming a cover, including a central panel, a first flap, and a second flap.

With reference to FIG. 2, a second preferred embodiment is shown which includes a second flap 70 of flexible sheet material. The second flap 70 has a first edge 72, a second edge 74, a third edge 76, a fourth edge 78, and a fifth edge 80.

Figure 7:
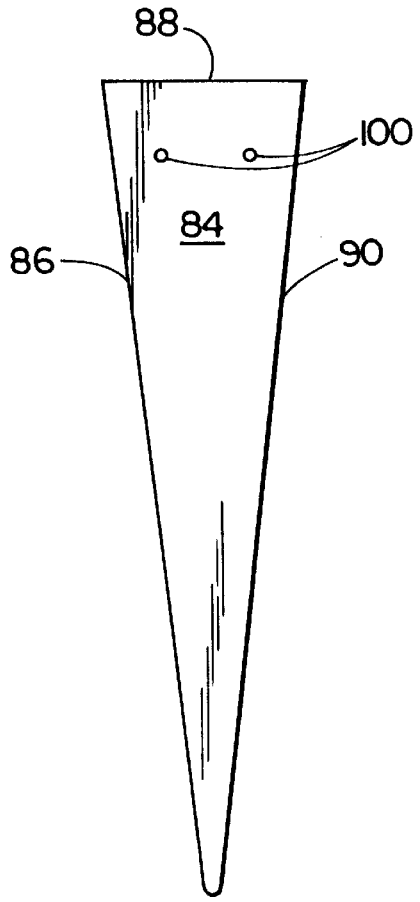
FIG. 7 shows in a rear elevational view, the fourth panel of the cover.
Figure 9:
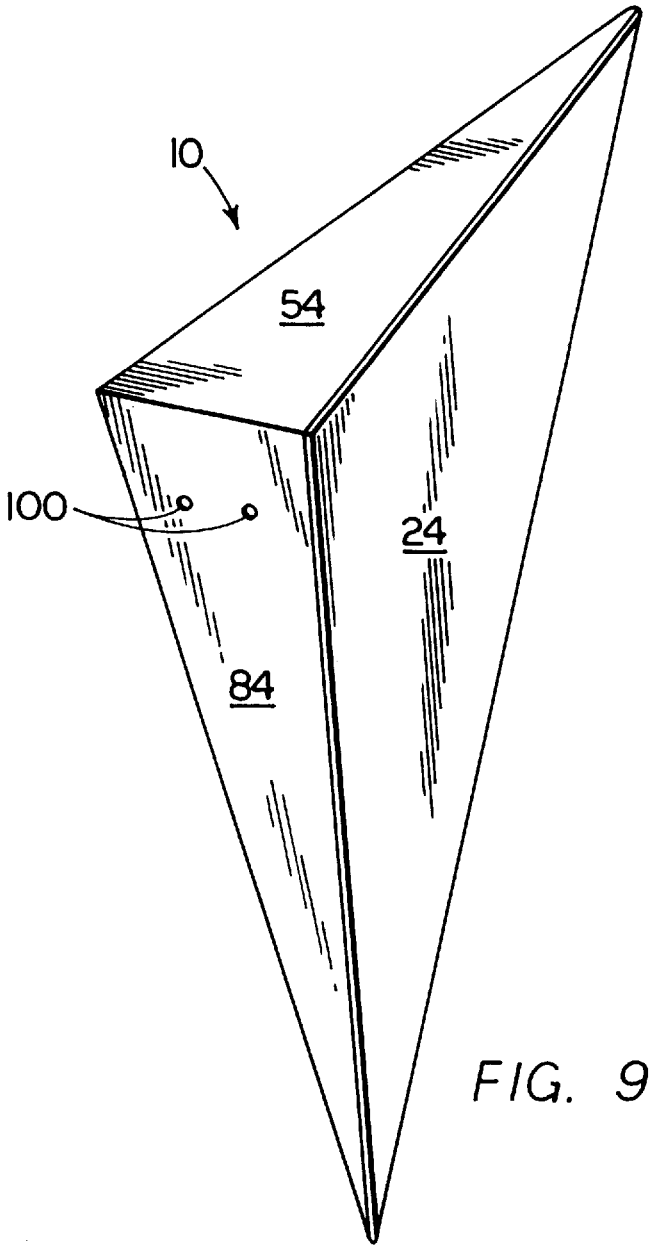
FIG. 9 shows a rear perspective view of the second preferred embodiment of the cover.

The first edge 72 of the second flap 70 is hingedly joined to the third edge 18 of the central panel 12 at a fourth fold line 82. With reference to FIGS. 2, 7 and 9, the fourth fold line 82 permits the second flap 70 to be folded so as to form a fourth panel 84, providing a rear wall, connecting the second and the third edges 16, 18 of the central panel 12. The fourth panel 84 has a first edge 86, second edge 88 and third edge 90 which are respectively coincident with the first edge 72, the fifth edge 80 and a fifth fold line 92 of the second flap 70, the first edge 72 of the second flap 70 being coincident with the fourth fold line 82.

With continuing reference to FIG. 2, an end of the second edge 74 of the second flap 70 is positioned adjacent the first edge 72 of the second flap 70. The first and the second edges 72, 74 of the second flap 70 define an acute angle 94 between them. The angle 94 may be defined by a cut or a fold along the second edge 74. The acute angle 94 between the first and second edges 72, 74 of the second flap 70 permits the second flap 70 to be folded along the fourth fold line 82 without interfering with the central panel 12.

An end of the third edge 76 of the second flap 70 is positioned adjacent the end of the second edge 74 of the second flap 70 opposite the end at which the first edge 72 is adjacent. An end of the fourth edge 78 of the second flap 70 is positioned adjacent the end of the third edge 76 of the second flap 70 which is opposite the end to which the second edge 74 of the second flap 70 is adjacent. One end of the fifth edge 80 of the second flap 70 is positioned adjacent the first edge 72 of the second flap 70 and the other end of the fifth edge 80 is positioned adjacent the edge of the fourth edge 78 of the second flap 70 opposite the end to which the third edge 76 is adjacent.

The fifth fold line 92 is defined on the second flap 70, extending along a hypotenuse of a triangle formed by the first 72 and the fifth edges 80 of the second flap 70. The fifth fold line 92 allows a portion of the second flap 70 to be folded flat against the central panel 12, thereby permitting the second flap 70 to be secured into place relative to the central panel 12 through the use of adhesives, fasteners and the like.

Figure 3:
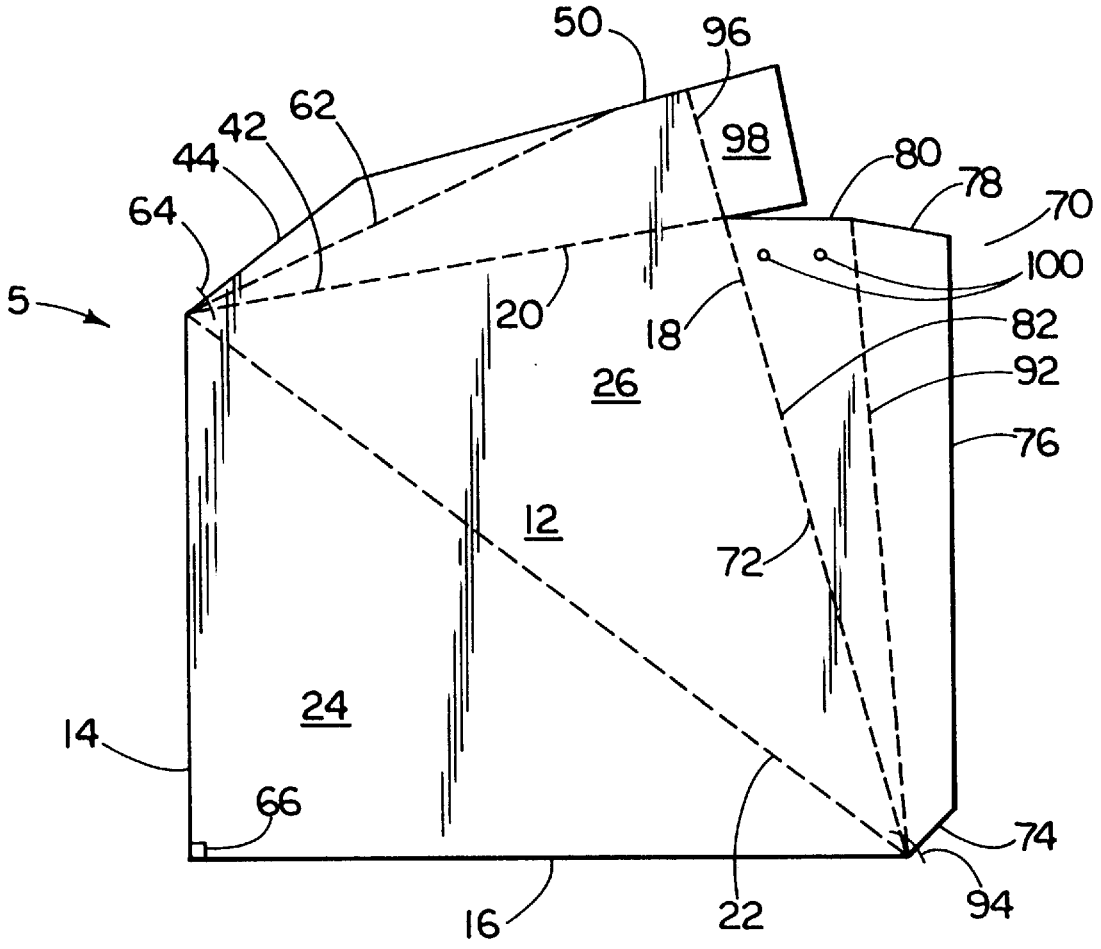
FIG. 3 shows a third preferred embodiment of an article for forming a cover, having an additional tab defined on the first flap.

With reference to FIG. 3, a third preferred embodiment is shown. The third embodiment includes a sixth fold line 96 defined on the first flap 40. When folded inward, a portion 98 of the first flap 40 beyond the sixth fold line 96 will lie flat against the inside of the second flap 70. The portion may be secured to the second flap 70 as will be described.

Any conventional means may be employed for connecting the first 40 and second flaps 70 to the central panel 12. Adhesive strips positioned on the first 40 and second flaps 70 are preferred. Hook and loop fastener, adhesive tape, glue, clips, staples, snaps, ribbon, screws, welding, and rivets are just a few of the other means which may be used. Alternatively, portions of the first 40 and second flaps 70 can be defined as tabs to be securingly received in respective slots (not shown) defined in the first 24 and second 26, or central panel 12.

In use, the flexible sheet material 5 can be easily manipulated into a cover 10 simply be folding and securing ends together.

The central panel 12 is first folded along the first fold line 22, the corner defined by the intersection of the first 14 and second 16 edges of the central 12 and the corner defined by the third 18 and fourth edges 20 of the central panel 12 being drawn together. Thus folded, the central panel 12 forms a first 24 and a second 26 panel which serve as the principal sides of the cover 10. The angle between the first and the second panels 24, 26 may be varied to suit one's taste since this angle dictates the eventual width of the cover 10. The length of the third edge 46 of the first flap 40 should be adjusted to accommodate for the desired width of the cover.

Next, the first flap 40 is folded at the second fold line 52, inward and toward the first edge 14 of the central panel 12. The first flap 40 is then folded at the third fold line 62, again inward with respect to the first panel 24, such that the area bounded by the third fold line 62 and the second 44, fourth 48, and fifth edges 50 of the first flap 40 lies flat against the inside of the first panel 24. The area is the secured to the inside of the first panel 24 such that the third fold line 62 is adjacent and parallel to the first edge 14 of the central panel 12. A pre-positioned self-adhesive strip is preferred for securing the first flap 40 to the central panel 12. The area between the third fold line 62 and the first 42 and third 46 edges of the first flap 40 thus defines a third panel 54 which normally serves as top for the cover 10, but could also serve as a bottom for the cover 10 depending on how the cover 10 is installed.

If a second flap 70 is provided, it is folded into position to serve as a fourth panel 84 for being located flat against the wall on which the cover 10 will be located. The second flap 70 is folded along the fourth fold line 82, inward with respect to the first and second panels 24, 26 of the central panel 12. The second flap 70 is also folded along the fifth fold line 92, again inward such that the area between the fifth fold line 92 and the second 74, third 76 and fourth edges 78 of the second flap 70 lies flat against the inside of the first panel 24 of the central panel 12, the fifth fold line 92 positioned adjacent and parallel to the second edge 16 of the central panel 12. The area is secured to the inside of the first panel 24 such that the third fold line 62 is positioned adjacent and parallel to the first edge 14 of the central panel 12. Again, a pre-positioned self-adhesive strip is preferred for securing the second flap 70 to the central panel 12.

Apertures 100 may be defined in the second flap 70 for allowing the bracket or fasteners to pass through the cover 10 so that the bracket may be fixed to the wall.

Figure 10:
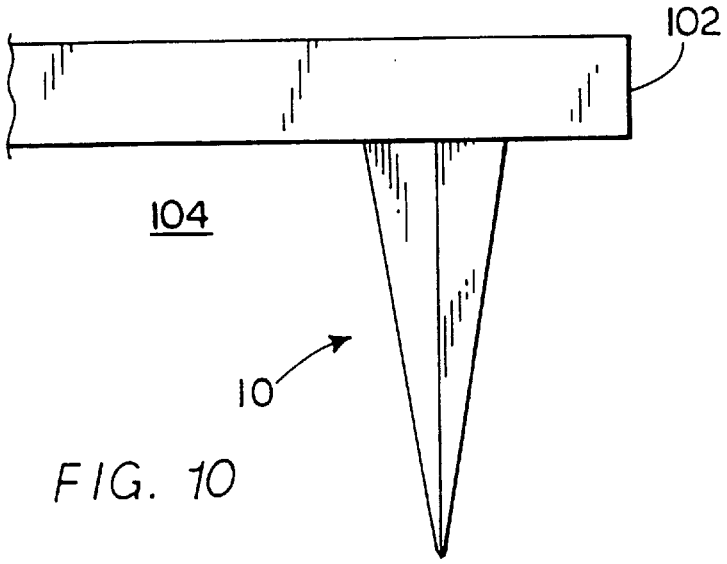
FIG. 10 shows a front elevational view of the cover mounted about a bracket and under a shelf.
Figure 11:
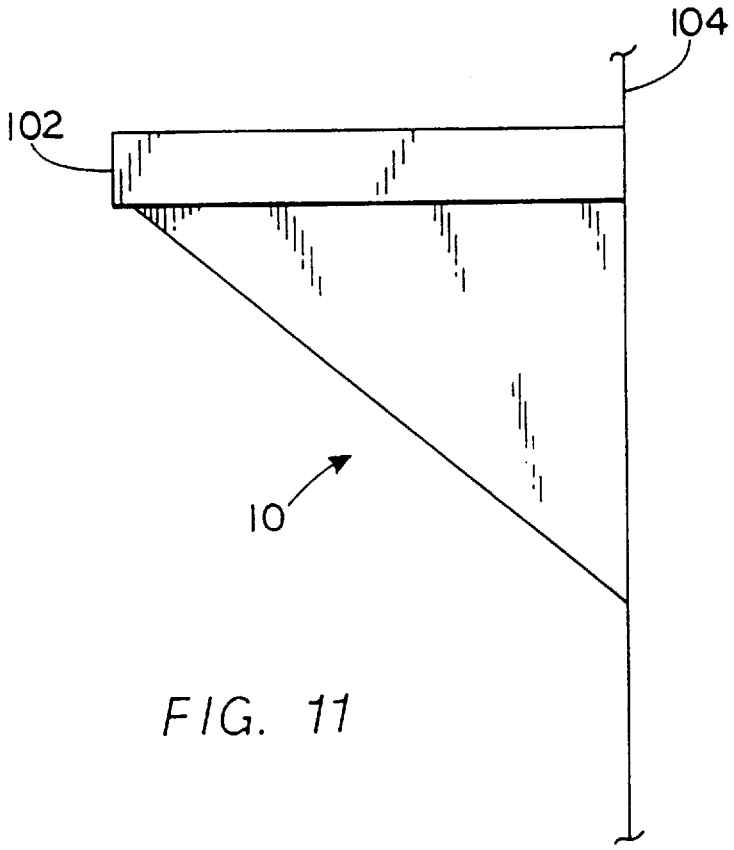
FIG. 11 shows a right side elevational view of the cover mounted about a bracket and under a shelf.

With reference to FIGS. 10 and 11, the cover 10 is normally put in use by folding it around the bracket (not shown) it is to cover. The first 24 and the second 26 panels serve as the primary surfaces. The third panel 54, or first flap 40, normally acts as the upper surface, which is received flush with the bottom of a shelf 102. When only a first flap 40 is provided, the open rear portion is received flush with the wall 104. When a second flap 70 is provided, the outside surface of the second flap 70 is received flush with the wall 104. The cover 10 is preferably secured to the shelf 102 and/or wall 104 by way of adhesive, although a friction fit will suffice in most instances.

The central panel 12 and the first 40 and second 70 flaps may be formed from paper, paperboard, fiberboard, paperboard coated with plastic, corrugated cardboard and light gauge metal. The gauge of the metal should be sufficiently light, so as to allow the material to be folded without the need of excessive force or tools. Other flexible materials may be used, although paperboard and cardboard are preferred.

Since all of the folds are made to the inside, an inside surface and an outside surface can be defined. The outside surface may be painted or colored in any conventional manner. Various surface ornamentation may be pre-positioned on the outside surface, such as stripes or geometrical patterns. Three dimensional geometrical patterns may even be formed in the outside surface such as is done when molding paper in a form. Alternatively, a variety of surface ornamentation may be provided with the cover for the user to position in whatever style he or she prefers. Such can take the form of self-adhesive decals and the like. The cover may even be painted by the user to match any decor, or simply replaced at little expense or inconvenience.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principals of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims which follow.

I claim:

1. A cover for a bracket, the cover comprising:

a generally triangular first panel of flexible sheet material having a first edge, a second edge adjacent to the first edge, a substantially right angle defined between the first edge and the second edge and a third edge defined along a hypotenuse of the first panel;

a generally triangular second panel of flexible sheet material having a first edge, a second edge adjacent to the first edge, a substantially right angle defined between the first edge and the second edge and a third edge defined along a hypotenuse of the second panel, the third edge of the second panel hingedly connecting the third edge of the first panel along a first fold line;

a generally triangular third panel of flexible sheet material having a first edge, the first edge of the third panel hingedly connecting the first edge of the second panel along a second fold line, a second edge of the third panel adjacent to the first edge thereof, and a third edge of the third panel adjacent to both the first edge and the second edge thereof, the first edge and the second edge of the third panel forming an acute therebetween, the third edge of the third panel positioned adjacent and parallel to the first edge of the first panel; and means for attaching the third edge of the panel to the first of the first panel.

2. The cover of claim 1 wherein the attaching means comprises:

a third fold line defined on the third panel.

3. The cover of claim 2 wherein:

the cover further comprises a material selected from the group consisting of paper, paperboard, fiberboard, paperboard coated with plastic, corrugated cardboard and metal.

4. The cover of claim 2 further comprising:

a generally triangular fourth panel of flexible sheet material having a first edge, a second edge and a third edge, the first edge of the fourth panel hingedly connecting the first edge of the second panel at a fourth fold line, the third edge of the fourth panel positioned adjacent and parallel the second edge of the first panel.

5. An article for forming a cover for a bracket, the article comprising:

a central panel of flexible sheet material, the central panel having a first edge, a second edge adjacent to the first edge, a third edge adjacent the second edge, a fourth edge adjacent the first and the third edges of the central panel and a first fold line defined along a hypotenuse of a triangle defined by the first and the second edges of the central panel; and a first flap of flexible sheet material, the first flap having a first edge hingedly joined to the fourth edge of the central panel at a second fold line, a second edge of the first flap adjacent the first edge of the first flap, the first and the second edges of the first flap defining an acute angle therebetween, a third edge of the first flap adjacent the first edge of the first flap, a fourth edge of the first flap adjacent the third edge of the first flap, a fifth edge of the first flap adjacent the second and the fourth edges of the first flap, and a third fold line extending along the hypotenuse of a triangle defined by the first and the third edges of the first flap.

6. The article of claim 5 wherein:

an acute angle is defined between the fourth edge of the central panel and the second edge of the first flap.

7. The article of claim 6 wherein:

the third edge of the first flap is collinear to the third edge of the central panel.

8. The article of claim 5 further comprising:

a second flap of flexible sheet material, the second flap having a first edge hingedly joined to the third edge of the central panel at a fourth fold line, a second edge of the second flap adjacent the first edge of the second flap, a third edge of the second flap adjacent the second edge of the second flap, a fourth edge of the second flap adjacent the third edge of the second flap, a fifth edge of the second flap adjacent the first and the fourth edges of the second flap and a fifth fold line extending along a hypotenuse of a triangle formed by the first and the fifth edges of the second flap.

9. The article of claim 8 wherein:

an acute angle is defined between the fourth edge of the central panel and the second edge of the first flap.

10. The article of claim 9 wherein:

the first edge and the third edge of the central panel are equal length; and the second edge and the fourth edge of the central panel are equal length.

11. The article of claim 10 wherein:

the first and the second edges of the central panel define a substantially right angle therebetween; and the third and the fourth edges of the central panel define a substantially right angle therebetween.

12. The article of claim 11 wherein:

the article comprises a material selected from the group consisting of paper, paperboard, fiberboard, paperboard coated with plastic, corrugated cardboard and metal.

13. A cover for a bracket which comprises:

a central panel of flexible sheet material, the central panel having a first edge, a second edge adjacent to the first edge, a third edge adjacent the second edge, a fourth edge adjacent the first and the third edges and a first fold line defined along a hypotenuse of a triangle defined by the first and the second edges of the central panel, the central panel folded along the first fold line such that a plane defined by the first and the second edges of the first panel intersects a plane defined by the third and the fourth edges of the first panel; and a first flap of flexible sheet material, the first flap having a first edge hingedly joined to the fourth edge of the central panel at a second fold line, a second edge of the first flap adjacent the first edge of the first flap, the first and the second edges of the first flap defining an acute angle therebetween, a third edge of the first flap adjacent the first edge of the first flap, a fourth edge of the first flap adjacent the third edge of the first flap, a fifth edge of the first flap adjacent the second and the fourth edges of the first flap, and a third fold line extending along a hypotenuse of a triangle defined by the first and the third edges of the first flap, the first flap folded along the second and the third fold lines such that a portion of the first flap between the third fold line, the second, the fourth and the fifth edges of the first flap lies flat against the central panel.

14. The cover of claim 13 wherein:

an acute angle is defined between the fourth edge of the central panel and the second edge of the first flap.

15. The cover of claim 14 wherein:

the third edge of the first flap is collinear to the third edge of the central panel.

16. The cover of claim 13 further comprising:

a second flap of flexible sheet material, the second flap having a first edge hingedly joined to the third edge of the central panel at a fourth fold line, a second edge of the second flap adjacent the first edge of the second flap, a third edge of the second flap adjacent the second edge of the second flap, a fourth edge of the second flap adjacent the third edge of the second flap, a fifth edge of the second flap adjacent the first and the fourth edges of the second flap and a fifth fold line extending along a hypotenuse of a triangle defined by the first and the fifth edges of the second flap, the second flap folded along the fourth and the fifth fold lines such that a portion of the second flap between the fifth fold line and the second, the third, and the fourth edges of the second flap lies flat against the central panel.

17. The cover of claim 16 wherein:

an acute angle is defined between the fourth edge of the central panel and the second edge of the first flap.

18. The cover of claim 17 wherein:

the first edge and the third edge of the central panel are equal length; and the second edge and the fourth edge of the central panel are equal length.

19. The cover of claim 18 further comprising:

the first and the second edges of the central panel defining a substantially right angle therebetween; and the third and the fourth edges of the central panel defining a substantially right angle therebetween.

20. The cover of claim 19 wherein:

the cover comprises a material selected from the group consisting of paper, paperboard, fiberboard, paperboard coated with plastic, corrugated cardboard and metal.

21. A method of forming a cover for a bracket which comprises the steps of:

i) providing an article which comprises:

a central panel of flexible sheet material, the central panel having a first edge, a second edge adjacent to the first edge, a third edge adjacent the second edge, a fourth edge adjacent the first and the third edges of the central panel and a first fold line defined along a hypotenuse of a triangle defined by the first and the second edges of the central panel; and at least one of (a) and (b):

(a) a first flap of flexible sheet material, the first flap having a first hingedly joined to the fourth edge of the central panel at a second fold line, a second edge of the first flap adjacent the first edge of the first flap, the first and the second edges of the first flap defining an acute angle therebetween, a third edge of the first flap adjacent the first edge of the first flap, a fourth edge of the first flap adjacent the third edge of the first flap, a fifth edge of the first flap adjacent the second and the fourth edges of the first flap, and a third fold line extending along the third side of a triangle defined by the first and the third edges of the first flap;

(b) a second flap of flexible sheet material, the second flap having a first hingedly joined to the third edge of the central panel at a fourth fold line, a second edge of the second flap adjacent the first edge of the second flap, the first and the second edges of the second flap defining an acute angle therebetween, a third edge of the second flap adjacent the second edge of the second flap, a fourth edge of the second flap adjacent the third edge of the second flap, a fifth edge of the second flap adjacent the first and the fourth edges of the second flap and a fifth fold line extending along a third side of a triangle formed by the first and the fifth edges of the second flap;

ii) folding the central panel along the first fold line to a position; and performing at least one of steps (A) and (B):

(A) folding the first flap along the second and the third fold lines such that a portion of the first flap between the third fold line, the second, the fourth and the fifth edges of the first flap lies flat against the central panel;

(B) folding the second flap along the fourth and the fifth fold lines such that a portion of the second flap between the fifth fold line and the second, the third, and the fourth edges of the second flap lies flat against the central panel; and iii) securing at least one of the first flap and the second flap to the central panel.

22. The method of claim 21 wherein:

the article comprises a material selected from the group consisting of paper, paperboard, fiberboard, paperboard coated with plastic, corrugated cardboard and metal.

* * * * *